United States Patent [19]

Sowa et al.

[11] Patent Number: 4,998,619

[45] Date of Patent: Mar. 12, 1991

[54] CLOSE-PACK, VERTICAL-STACK WEBBING ROLL PACKAGING

[75] Inventors: Paul E. Sowa, Wheeling, Ill.; Neil D. Linnerud, Sparks, Nev.

[73] Assignee: Signode Corporation, Glenview, Ill.

[21] Appl. No.: 370,820

[22] Filed: Jun. 23, 1989

[51] Int. Cl.[5] ..... B65D 85/67; B65H 49/00; B65H 75/02

[52] U.S. Cl. ..... 206/392; 108/53.5; 206/386; 206/394; 206/497; 206/597; 242/130.2; 242/139; 242/141

[58] Field of Search ..... 206/391, 392, 394, 386, 206/597, 497, 499; 108/51.3, 53.1, 53.5; 242/130.2, 130, 132, 134, 139, 141, 146

[56] References Cited

U.S. PATENT DOCUMENTS

| | | | |
|---|---|---|---|
| 1,808,651 | 6/1931 | Gibb et al. | 206/392 |
| 2,326,928 | 8/1943 | Courson | 206/392 |
| 2,570,340 | 10/1951 | George | 206/392 |
| 2,617,524 | 11/1952 | Rosenberg | 206/392 |
| 2,699,866 | 1/1955 | Russell, Jr. | 206/394 X |
| 3,227,272 | 1/1966 | Critzer | 206/392 |
| 3,407,758 | 10/1968 | Simkins | 108/51.3 |
| 3,709,161 | 1/1973 | Kauffman | 108/51.3 X |
| 4,319,530 | 3/1982 | Moog | 108/51.3 |
| 4,516,677 | 5/1985 | Rowland et al. | 206/394 |

FOREIGN PATENT DOCUMENTS

| | | | |
|---|---|---|---|
| 3637619 | 5/1988 | Fed. Rep. of Germany | 206/386 |
| 3707958 | 9/1988 | Fed. Rep. of Germany | 206/597 |
| 742959 | 1/1956 | United Kingdom | 206/392 |

*Primary Examiner*—Bryon P. Gehman
*Attorney, Agent, or Firm*—Thomas W. Buckman; Donald Breh

[57] ABSTRACT

A shipping package system with at least one tier of vertically-stacked webbing rolls utilizes pads with an inner set of passages and an outer set of passages, which webbing rolls may have extended tubular core ends nesting in the pad passages. The outer set of passages accommodate radial webbing roll movement and inhibit circumferential movement about the pad center, which radial movement provides tangential contact between adjacent and/or inner passage webbing rolls.

21 Claims, 3 Drawing Sheets

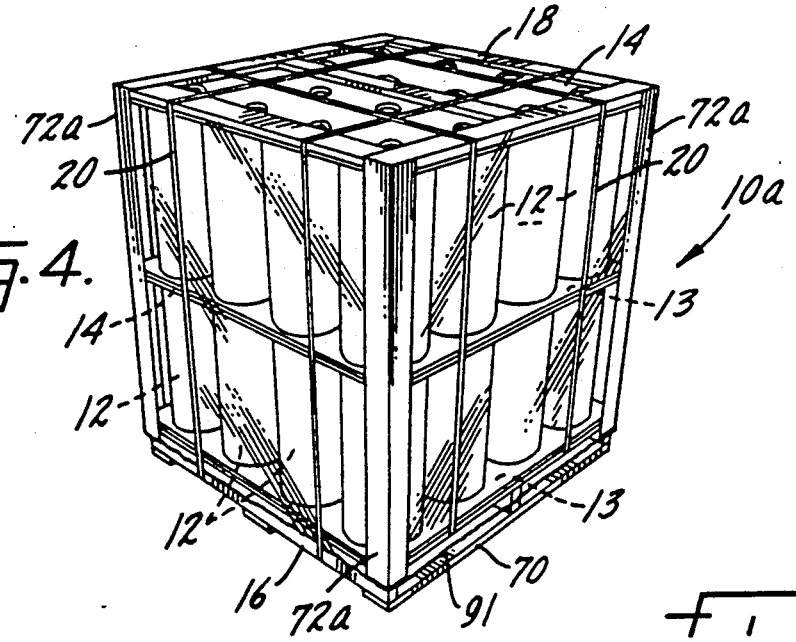
Fig. 4.
Fig. 5.
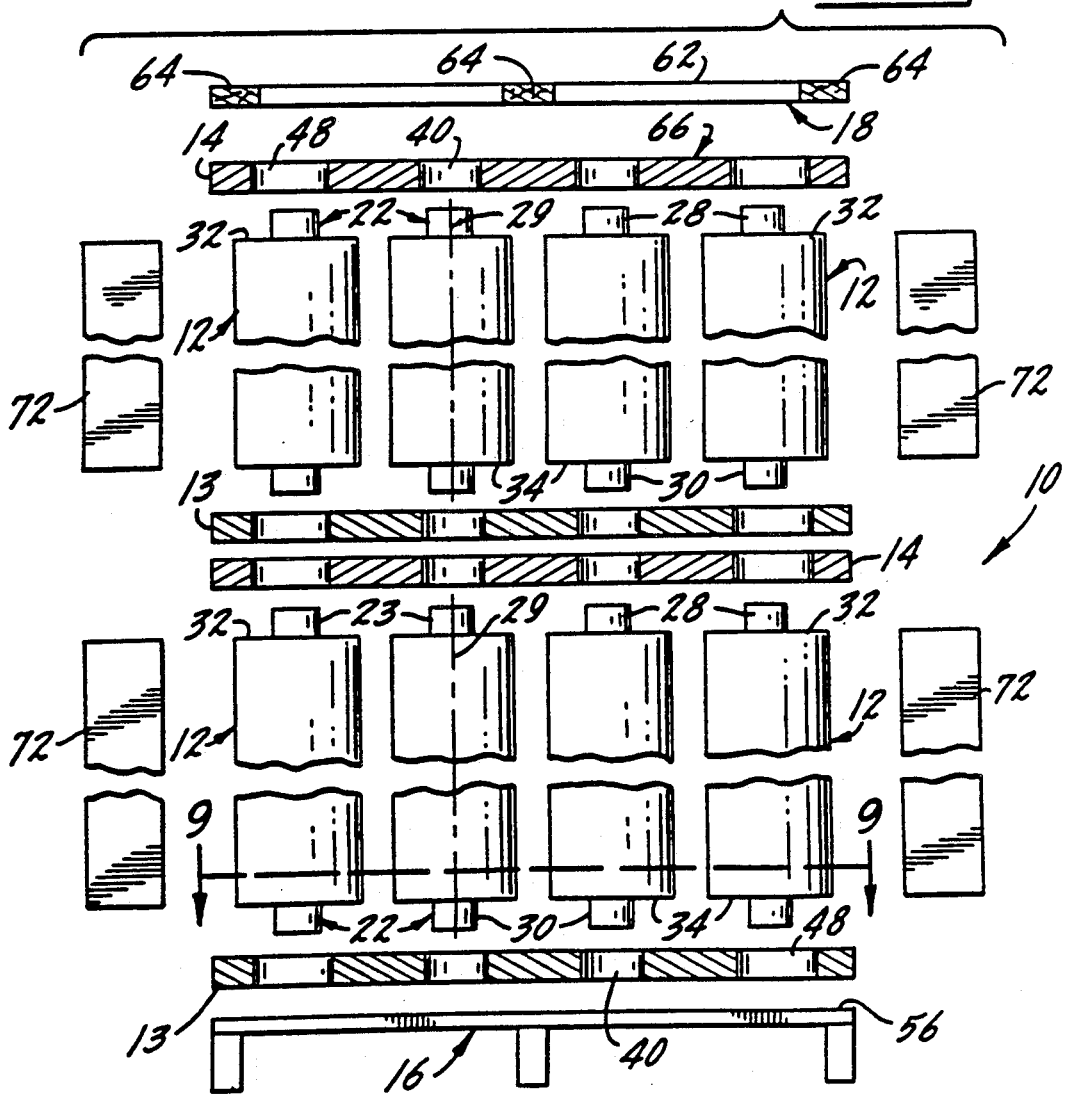

CLOSE-PACK, VERTICAL-STACK WEBBING ROLL PACKAGING

BACKGROUND OF THE INVENTION

The present invention relates to an improved packaging arrangement, particularly for the packaging and shipment of webbing rolls wound on tubular cores and vertically stacked for intimate contact in a close-packed arrangement.

Problems with the storage and transportation of webbing materials roll-wound on tubular cores are common and prevalent in various industries, such as those involving paper products, yarn and threads, and cellophane and/or stretch film wrapping. These materials are both stored and shipped in multi-roll packaging arrangements or containers, which provide both a shipping carton and a protective structure to minimize damage to roll-wound material. Some of these protective transport arrangements provide the tubular core and webbing roll in a horizontal plane with the webbing material cradled and secured between packing bars and supported by extending tubular core ends in a cradle or yoke. Alternatively, the webbing roll may rest in the cradle or yoke on the roll ends. These cradles secure and nest the webbing rolls in appropriate slots, and maintain such rolls in a fixed position during storage and shipment. However, the rolls are known to shift slightly from movement during handling and vehicle transport, which movement may cause contact with external objects, resulting in surface damage to the webbing material. The webbing material surface is the most sensitive part of the web roll, as it is vulnerable to marring and abuse, which would make the webbing material an unacceptable product.

As noted above, common arrangements for the stacking, storage and transport of web reels or rolls provide the tubular core and web roll either vertically or horizontally in a cradle or yoke. A webbing roll-horizontal arrangement for storage and shipment is illustrated in U.S. Pat. No. 4,151,914 to Blatt. A webbing roll is positioned in a container or box arrangement having an open top with slotted ends to receive extended ends of a webbing roll tubular core. The cradle supports have hemispherical seats to receive the extending part of the tubular core. Cradle supports at both ends of the tubular core accommodate the webbing material between the supports and within the box structure. The box sections, as shown in the Figures of this patent, include windows alignable with the tubular cores and the box top is sealed with a mating lid. The boxed material or goods are removable by the insertion of a bar along or through the hollow interior of the tubular core.

A similar web-protective structure is illustrated in U.S. Pat. No. 4,195,732 to Bell. In this patent, a bar with semicircular indentations is disclosed for receiving webbing rolls, which bar is flexible to permit limited movement of the rolls in the indentations. The webbing rolls or webbing material rests in the indentations at approximately the web roll ends, and thus is in constant communication with the bar. Multi-tiered arrangements of webbing materials are typically stacked in layers on pallets, and have multiple supporting and spacing members, each with a plurality of indentations or notches for the nesting rolls. In this arrangement, multiple-stacked rolls provide a load on the below-nested rolls of a multi-tiered package. The bar thickness is adequate to separate the webbing material and protect each webbing roll from intimate contact with other webbing rolls in the stacked pallet arrangement.

Webbing rolls may be provided on tubular cores without extended ends, but tube extensions may be inserted in the cores, which tube extensions extend to rest on a platen or other structure and support the webbing material between tube extensions and nesting platens. There are several variations of the tube and cradle arrangement for cradling and supporting the tubes and webbing rolls. The horizontal stacking arrangements are most prevalent in the industry, and minimize movement of the packaging. However, either vertical or horizontal stacking of the webbing requires packaging to secure and hold the roll for storage or transport, while insulating or protecting the web rolls from contact, abuse, marring or other physical damage of the webbing material surface and body.

A vertically-stacked web packaging arrangement has been considered as a desirable alternative to horizontal stacking of webbing materials. In this arrangement, it is considered that the probability of damage to the rolls will be minimized, while reducing the cost of the packaging arrangement, as the webbing rolls may provide support for the package structure. However, an inherent problem with vertically stacked rolls has been packaging instability because of the shifting of an elongated roll on a smaller or narrower base, that is the end of the roll. Unlike the horizontal packaging systems, prior art vertical packaging systems have been relatively intolerant to forces applied transversely to the rolls. Consequently, various alternative stacking plans have been considered to overcome shifting in vertical stack packaging. In U.S. Pat. No. 4,516,677 to Rowland et al., a vertical stacking arrangement for webbing rolls, particularly for use with yarn packages having tubular cores, utilizes a molded pallet of plastic material, such as high density polyethylene HPED, having a repeating pattern of nubs and depressions. The nubs are operable to receive an extending end of a tubular core. An overlying yarn spool wound about a tubular core fits into a depression on the top surface. The underside or bottom surface of the pallet is provided with a mating depression and a cone end to receive the tube end of the upper surface of the underlying or lower yarn spool. This stacking arrangement provides the spools in vertical alignment along the tube cores in the depressions, and tube nubs of the stacked spools of yarn. The yarn spools are held relatively immobile in a tiered and vertically stacked arrangement. A number of layers of spools may be provided, and slots in the sidewalls of the pallets accommodate a binding means, such as a strap, to lash the several stacked pallets together, to avoid shifting of the stacked spools, and to provide a secure package. These pallets, however, are relatively expensive and if they are utilized repeatedly may require storage and special handling.

It has been found that in the vertical stacking of the various webbing rolls, it is desirable to pack the webbing rolls in proximity to each other with a line of surface contact, and thereafter to lash the stacked arrangement to its lower, or support platform or frame. This arrangement maintains the rolls in intimate contact during transport and storage, minimizes shifting of vertically-stacked rolls by utilizing the roll sidewalls as the contact surface, and thus minimizes marring and marking of the webbing roll surface.

SUMMARY OF THE INVENTION

The present invention provides a shipping package for vertically stacking at least one tier of webbing rolls on a platform base. The webbing rolls generally include a web of material wound on a core tube with ends extending from the webbing roll ends, which tube is nested into a port or passage in a pad having a first arrangement of ports or passages about the center of the pad, and a plurality of second sets of slots or passages. Each of the second sets of slots is associated with one of the first or inner passage ports and has a generally elliptical or ovate shape.

A tubular end of a webbing roll core is mated in each of the first and second sets of passages in a first or lower pad on a platform. A second pad with symmetrically positioned first and second passages and slots is mated on the opposite end of the webbing roll cores. The pads are a laminated fiberboard material with an interlayer of a honeycomb structure laminated between two sheets of paperboard for support strength and stability. Each of the webbing rolls inserted in the second sets of passages is movable along the ovate length to intimately contact the webbing rolls in its immediate proximity in the vertically stacked arrangement. The ovate-shaped passages accommodate variations in the webbing roll outer diameters while allowing roll adjustment for web roll-to-roll contact. The package may include multiple tiers of vertically-stacked webbing rolls which are lashed or bound to the platform by binding means. A further securing or bracing apparatus, such as a rigid structural frame, is provided across the top of the stacked webbing rolls and pads. A spiral wound stretch-wrap layer is wound on the perimeter of the tiers and the lashing or binding materials may be applied to the stacked webbing rolls, pads, platform and brace for added securement. All of the packaging components are relatively inexpensive, and require no special handling or storage.

BRIEF DESCRIPTION OF THE DRAWINGS

In the Figures of the drawings, like reference numerals identify like components, and in the drawings:

FIG. 4 is an alternative embodiment of the vertically-stacked packaging arrangement with package-length external edge protectors;

FIG. 5 is an exploded side view of the package of FIG. 1 with the webbing rolls separated for clarity;

DETAILED DESCRIPTION OF THE PREFERRED EMBODIMENT

Reels of web or roll materials such as yarn, paper, and plastic wrap, are transferred and stored in various packages, packaging means and packaging configurations. The configurations generally provide either horizontally or vertically stacked arrangements of the webbing rolls along their longitudinal axes. It is required that the packaging maintain the vertical or horizontal roll alignment and protect the webbing rolls from damage, especially mechanical damage to the webbing surfaces. The packaging must be sturdy enough for handling and transfer of the stacked rolls, such as transfer in a truck or railroad car, as well as for handling by various devices, such as a forklift, in a warehouse or storage situation.

The present invention provides a packaging system for vertically-stacked webbing wound in rolls about tubular cores with extending core ends, which webbing rolls may be nested between two pads or separator sheets with a plurality of passages or depressions to receive the extended cores. A first set of passages is provided in proximity to the pad center and a second set of passages is radially outwardly displaced from the first set. The second set of passages are generally elliptical or ovate shaped to provide a means for adjusting the outer rolls along a major axis of the ellipse for intimate contact with inner or nearest-neighbor rolls, which intimate contact limits movement of the vertically-stacked rolls during transport or storage. In these arrangements, the number of tiers or stacks of webbing rolls is dependent upon the shipper and the length of the rolls. In a preferred embodiment of rolls twenty inches in length, a stacking arrangement of two tiers of vertically-stacked rolls has been found to provide a stable and secure package for handling, transport, and storage of these rolls.

The packaging system or packaged rolls are generally mounted on a platform base with a first or lower pad positioned thereon. A first end of a webbing roll is positioned in each of the pad passages. A second pad is positioned on each of the webbing roll and other extending core ends in the passages of the second pad, which are aligned with the first pad passages. A second or multiple number of tiers of vertically stacked rolls may be stacked on the platform. However, the number of tiers may depend upon web roll length, which would determine the package height. Thus the number of tiers, which may effect package stability, will be dependent upon desired package height and package stability. An upper frame may be placed on the second pad of the top tier of stacked rolls and, thereafter, lashing or securing straps are applied around the package and the platform to secure the webbing rolls, pads and frame thereto.

Figure 1:
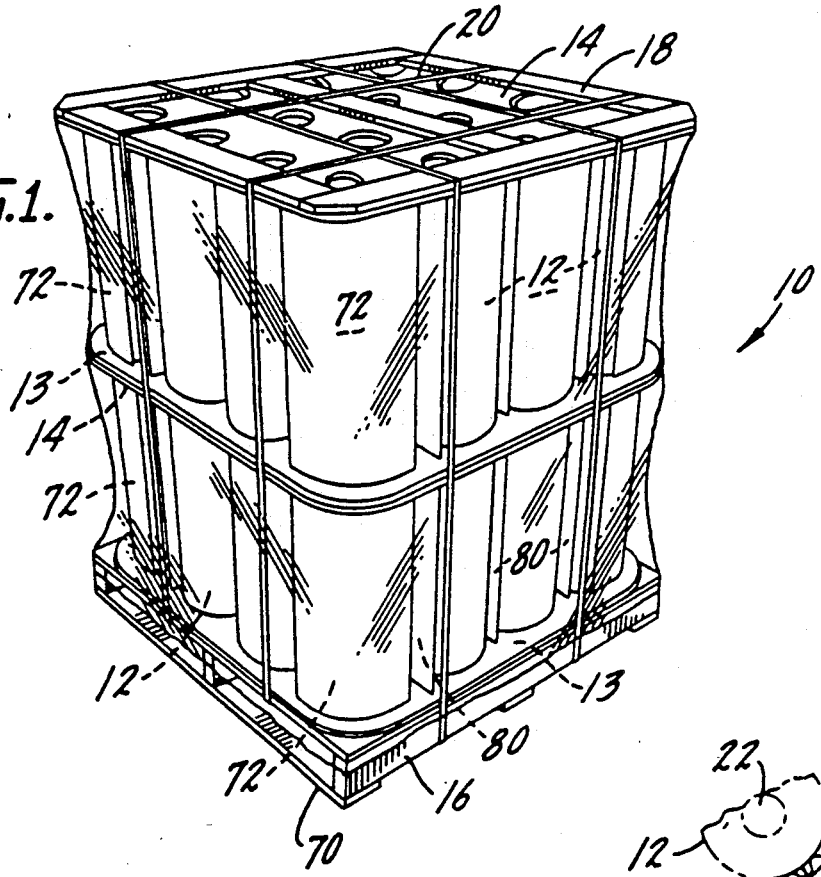
FIG. 1 is a perspective view of a dual-tiered, vertically-stacked package of webbing rolls.

In a preferred embodiment, a vertically-stacked arrangement 10 of two tiers of webbing rolls 12 is illustrated in a perspective view in FIG. 1, and in an exploded side view in FIG. 5. In this arrangement 10, a plurality of webbing rolls 12 in each tier are stacked between a first or lower pad 13 and a second or upper pad 14. Lower pad or separating sheet 13 of the lower tier is positioned on a platform or base 16, and the two-high stacked arrangement of the plurality of webbing rolls 12 is provided with an overlying upper frame 18 on the upper pad or separating sheet 14 of the second tier or upper stack of webbing rolls 12. Frame 18 provides stability for lashing and binding of the stacked rolls to the platform 16 by binding or tie means 20.

Figure 8:
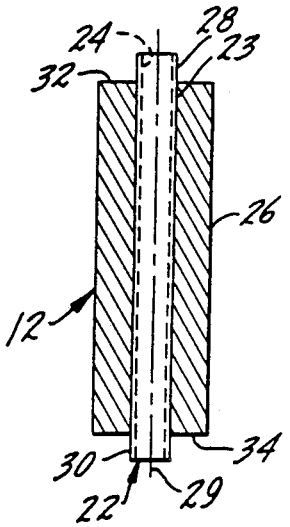
FIG. 8 is a sectional view of a webbing roll.
Figure 7:
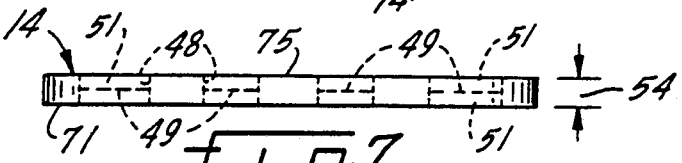
FIG. 7 is a side view of the pad of FIG. 3.

As noted in FIG. 8, webbing rolls 12 include a web core 22, with webbing material 26 wound thereon. Web core 22 is generally a right circular cylindrical tube in shape, but not limited to this tube shape, with wall 23 defining a passage or bore 24, and a longitudinal axis 29. Core 22 has first end 28 and second end 30, extending beyond first and second web roll ends 32, 34, respectively. The extending members or extensions 28, 30 of tubular core 22 are approximately uniform in length, which length is less than one-half thickness 54 of pads 13, 14 (cf., FIG. 7). In FIGS. 5 and 8, the first and second webbing roll ends 32, 34 are noted as an upper and lower end, respectively, in the vertical alignment of webbing rolls 12 and axis 29, but it is recognized that the ends 32 and 34 are interchangeable. Further, the shape of the webbing rolls 12 is merely exemplary and not a limitation.

Figure 6:
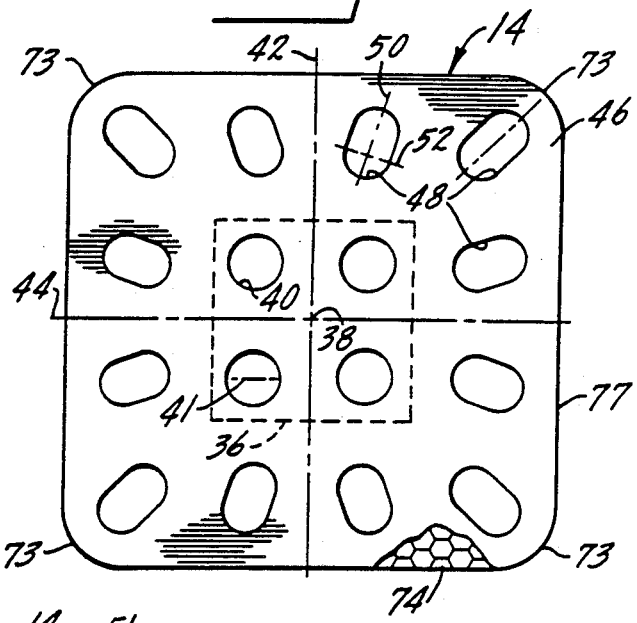
FIG. 6 is a plan view of the pad of the package of FIG. 1 with a partial cutaway section.

The pads 13 and 14 are similarly constructed and interchangeable, and therefore the pad description will refer to pad 14 but will be equally applicable to either pad. Pad 14 is noted in FIGS. 6 and 7 in a plan view and end view, respectively, and in these Figures, the configuration of the passages or slots is shown. In FIG. 6, a first set 36 of generally circular slots 40 with diameter 41 is positioned about the center 38, which is the geometric center of pad surface 46. The pad is sectioned by axes lines 42 and 44 intersecting at center 38, which provide a quadrant structure on pad surface 46 similar to the axes of a Cartesian coordinate system. In this quadrant arrangement, one of generally circular slots 40 is provided in proximity to center 38 in each quadrant, which circular slots 40 are noted in dashed outline in FIG. 6. In FIG. 6, a second set of slots or passages 48 in each quadrant of surface 46 cooperate with the passage 40 in each respective quadrant to define a family of passages in each of the quadrants. Although the slots 40, 48 are noted as through-passages, it is recognized that cup-shaped depressions aligned on each side of the pad, which are adequate to receive the tube ends would also be operable. These cup-shaped depressions 51 are illustrated by phantom lines 49, which may be a centerline divider, in FIG. 4, to divide the thickness 54 of pad 14.

Each of slots 48 in FIG. 6 of the second sets of passages is illustrated as having an approximately elliptical shape and is shown with its major axis 50 generally aligned along a radius extending from center 38. Each of the slots 40 and 48 are wide enough, either in diameter 41 or along minor axis 52 of slot 48, respectively, to receive one of the extending ends 28, 30 of core 22. Thickness 54 of pads 13, 14 is adequate to receive and retain two vertically-stacked ends 28, 30 whether slots 40, 48 are through-passages or depressions.

In the vertically-stacked pads of either FIG. 1 or FIG. 5, a plurality of webbing rolls 12 are vertically disposed along their longitudinal axis 29 for insertion of one of tube ends 28, 30 into any of slots 40 or 48. Stacking platform 16 is provided as a base for the vertically-stacked rolls 12. Lower pad 13 is positioned on a surface 56 of platform 16 as a first or lower pad, to receive the lower core end 28 or 30, which may be at either end 32 or 34 of one of the plurality of webbing rolls 12. As noted in FIGS. 1 and 5, a webbing roll 12 is provided for each of the passages 40 and 48. The agglomeration of vertically-stacked rolls 12 between pads 13 and 14 comprises one level or tier of the stacked arrangements illustrated in FIGS. 1 and 5. In these arrangements, the rolls 12 are brought into proximity at their outer edge or surface 60 to contact other vertically-stacked rolls in their immediate proximity at tangent or contact points 61, as shown in FIG. 9.

Figure 3:
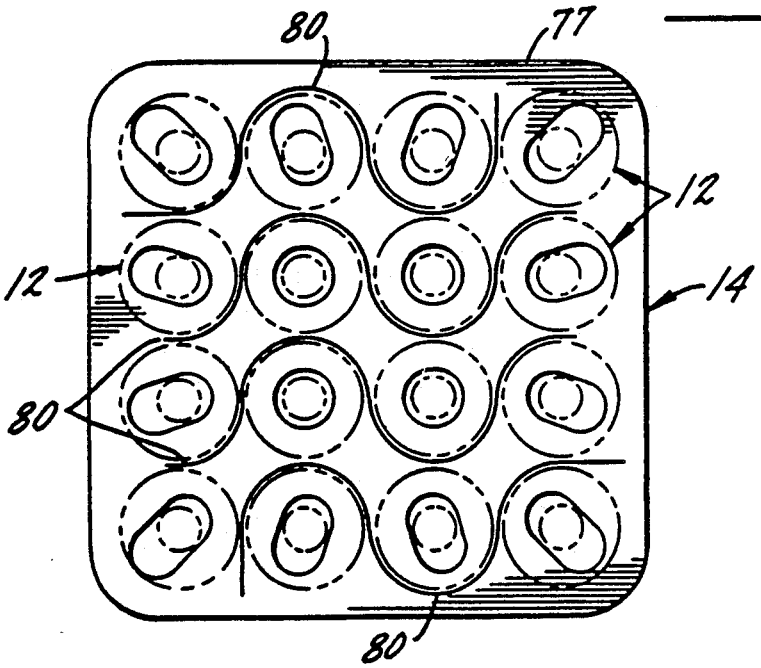
FIG. 3 is a plan view of a tier of stacked rolls of the package of FIG. 1 with a buffer sheet between rolls.
Figure 9:
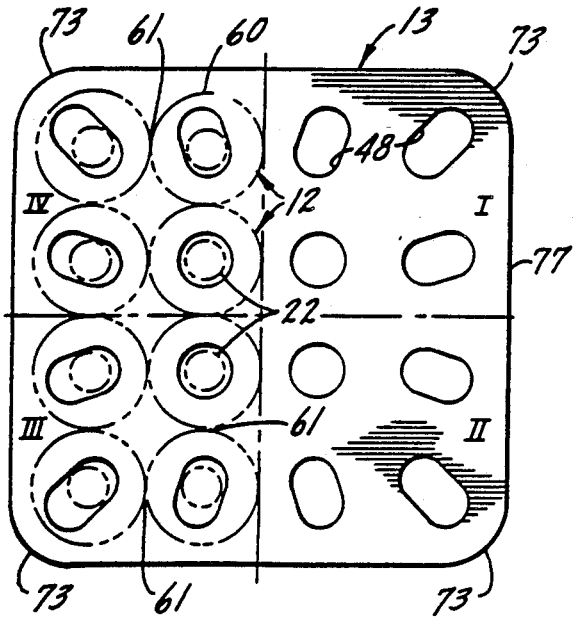
FIG. 9 is a top plan view of two rows of a single tier of webbing rolls taken along line 9—9 of FIG. 5.

In FIG. 9, the rolls in quadrants III and IV of pad 13 are illustrated in their contacting position, and it is noted that they contact at approximately tangents 61 to their outer surfaces 60. The contact is intimate but it is not a highly-stressed compressive load placed upon the webbing surface of rolls 12 at tangents 61, thus avoiding damage to the webbing material 26. Alternatively, a divider or plurality of dividers or buffer sheets 80, which may be single-layer paper, may be intertwined between adjacent rolls 12 to prevent intimate roll surface contact, as shown in FIG. 3. The webbing rolls 12 with core ends 28, 30 in slots 40 are approximately immovable either radially from center 38 or rotationally about center 38. However, rolls 12 and more particularly, tubular ends 28, 30 in slots 48 are slidable along slots 48 generally along a radius through center 38 to effect the above-noted tangential contact between adjacent rolls 12. The surface-to-surface or surface-to-divider contact with adjacent rolls completely around the pad structure provides a tight package of webbing rolls 12 without application of a highly-stressed, compressive load on contacting surfaces 60. Thereafter, the second or upper pad 14 is positioned at the other of ends 32 or 34 to nest the other of the ends 28 or 30 in slots 40 or 48 therein and thus define a first tier of rolls 12 for packaging arrangement 10.

If it is desired, a single-tiered arrangement may be provided. In the illustrations of FIGS. 1 and 5, it is noted that a second tier, which is an identical arrangement of the first tier described above, is provided atop the first tier. An upper frame 18, shown in FIG. 10 in plan view, is provided atop upper pad 14 of the second tier. Frame 18 provides a more rigid top or upper surface, improves package stability and provides a solid, unyielding contact for the banding or binding loops 20 for package 10, which avoids placing a sharp contacting load on any of the rolls 12 or roll surfaces 60, distributes the securing load and avoids mechanical damage to any of rolls 12 from the bands 20 or other contacting surfaces.

Figure 10:
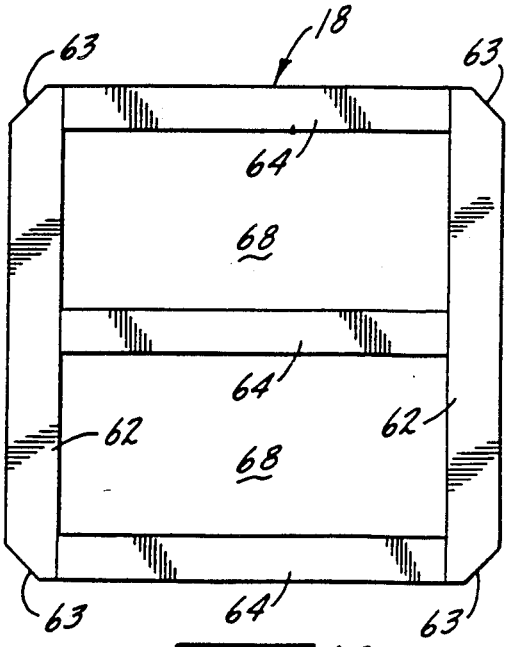
FIG. 10 is a plan view of an exemplary form of a top frame.

Frame 18, as noted in FIG. 10, may comprise as simple a structure as first braces or members 62 in parallel relationship, and cross braces 64 attached therebetween. The corners 63 of the generally rectangularly illustrated frame 18 are cut at an angle which approximately conforms to the corners 73 of pads 13 and 14, and provides a smoother surface for the stretch wrap 91 applied to the finished package to secure the rolls, pads and frame. The slots 40 and 48 at the top 66 of upper pad 14 in FIGS. 1 and 5 are generally in the gaps or voids 68 between the braces 62 and 64, but this is not requisite as the core ends 28 or 30 do not extend from slots 40 or 48. Binding means 20 is looped through the platform base 16, which may have slots or notches for this strapping or may be elevated above ground level by a shim board 70, shown in FIGS. 1 and 4, to provide a space to receive the binding straps comprising the binding means 20. The binding straps in FIG. 1 are cross-looped around package 10 to secure the webbing rolls 12 with a vertically-applied compressive load.

Figure 2:
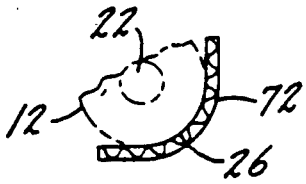
FIG. 2 is a plan view of a roll package corner protector.

Corrugated fiberboard corner protectors 72, which are approximately the same length as the webbing rolls, are positioned at each corner roll of each corner 73 on each pad 13 or 14. The corner protectors 72 in the preferred embodiment contact the corner rolls directly and fit between the pads 13, 14 of each tier. This allows tighter securement of the package when stretch film is applied to the vertical sides of the stacked rolls. As shown in FIG. 2, the corner guards 72 generally conform to the surface 26 of roll 12 and extend for a short distance along the surface 26 at each side of perimeter 77 of pads 13, 14.

The secured webbing rolls 12 shown in FIG. 1 have a vertical compressive load from their weight, and more affirmatively from the tension applied through binding straps 20, which straps place a vertical tensile load upon the upper frame or bracket 18 in the direction of lower platform base 16. The securing force load is applied on the tightly wrapped end surfaces 32, 34 of webbing rolls 12 and not on the webbing surface 26, which maintains the webbing rolls in intimate contact at their edge or tangential contact points 61, but does not permit lateral movement within the slots 48 and 40. Thus, the pads and packaging arrangement are a compact package, which is protective of the webbing surfaces 26, especially against mechanical damage from moving during transit and storage of these webbing rolls. The vertical arrangement provides a more appealing package to the user and limits the dust contacting or layering on the outer surface of at least the outer wrap of the packaged goods. Further, this arrangement minimizes the utilization of preformed or premolded cradles, which are relatively expensive, more bulky, thus requiring greater storage space; and, require special handling in their storage and assembly to stack a plurality of web rolls.

In the preferred embodiment, a buffer sheet 80 (shown as a single line due to minimal thickness) is interwoven between the vertically-stacked rolls of each row or file on each tier, as illustrated in FIG. 3. This interwoven buffer sheet 80 is loosely fit and allows freedom of movement of the unsecured webbing rolls. In addition, direct contact between adjacent surfaces 26 of webbing rolls 12 is prevented as the rolls are adjusted for tangential contact with their nearest neighbor. The illustration of woven buffer sheet 80 between rolls, which have not been adjusted for tangential contact, in FIG. 3 is merely exemplary and not a limitation.

Pads 13, 14 may be of a fiberboard or kraft paper with a laminate structure having an upper layer 75, a lower layer 71 and a honeycomb structure 74, as shown in partial section in FIG. 6, in the separation distance 54, which honeycombed arrangement provides added strength to support and retain the webbing rolls. However, pads 13, 14 may be of any material which provides a stable structure to support and cushion the webbing rolls. The passages 40 and 48 as noted above may have center line dividers 49 therein to provide aligned depressions 40 and 48 at upper layer 75 and lower layer 71 of each pad.

In FIG. 4, the alternative embodiment of the packaging arrangement **10*a* includes the vertically-stacked tiers of webbing rolls 12, pads 13, 14, and frame 18, which are again secured by stretch film 91 and binding straps 20 to platform 16. However, in this embodiment corner protectors 72*a* are provided as full-length corner guards applied at the outer corners of the package 10*a* and not applied directly to the corner rolls of each tier. In this arrangement, the corner guards 72*a* may be secured to frame 18 and platform 16**, and they may be of a different construction or material.

While only a specific embodiment of the invention has been described and shown, it is apparent that various alternatives and modifications can be made thereto. It is, therefore, the intention of the appended claims to cover all modifications and alternatives as may fall within the true scope of the invention.

What is claimed is:

1. A shipping package system with at least one tier of vertically-stacked webbing rolls, said package system comprising:

a stacking platform;

a plurality of webbing rolls, each webbing roll having a first roll end, a second roll end, and a cylindrical, tubular core with an outer diameter, a longitudinal axis, a first tube end and a second tube end extending outwardly from each of said webbing roll first and second ends, respectively;

a first pad and a second pad for each said tier of webbing rolls, each of said first and second pads having a center, a plurality of first passages, a plurality of sets of second passages for receiving tube ends, each of said sets of second passages operable with one of said first passages and radially, outwardly displaced from said center and said first passages;

at least one of said pads positioned on said stacking platform;

each of said first and second passages of one of said first and second pads in alignment with an opposed first and second passage in the other of said first and second pads, webbing roll tube cores with webbing rolls thereon extending approximately normally between and into each of said aligned first and second passages of each pair of first and second pads, said webbing rolls movable in said second passages to tangentially contact at least two of said webbing roll of said tier, and, means for securing, which means for securing extends around said pads and platform to secure said pads and webbing rolls to said platform.

2. A shipping package system as claimed in claim 1 wherein each of said sets of second passages comprise three generally elliptically-shaped passages, each of said elliptically-shaped passages having a major axis approximately aligned along radii extending from said center of said pad, and at least one minor axis, which minor axis is greater than said outer diameter of said tubular core to provide adjustable movement in said second passages for said webbing roll tubular cores.

3. A shipping package system as claimed in claim 2, wherein said means for securing comprises a first means for securing and a second means for securing said pads and webbing rolls to said platform.

4. A shipping package system as claimed in claim 3 wherein said vertically-stacked webbing rolls and said pads cooperate to provide a package having at least two vertical sides; and, one of said first and second means for securing being a stretch film wound about said package vertical sides and the other of said first and second means for securing is at least one binding strap extending around said pads, webbing rolls and platform.

5. A shipping package system as claimed in claim 4, said package having at least a first tier and a second tier of first and second pads with said webbing rolls arranged in vertically-stacked alignment, said package further comprising a plurality of corner guards and third securing means, each said tier having at least one package corner, a corner guard provided at each said package corner and secured to a webbing roll at said package corner.

6. A shipping package system as claimed in claim 2 wherein each of said pads has a generally rectangular shape with a pair of longitudinal sides, a pair of transverse sides and a pad perimeter, each of said passages of said set of second passages defines an inner and an outer extremity, which outer extremities are in proximity to a pad perimeter at one of said sides and are provided in parallel alignment to said one side with the other second passage extremities in proximity to said side.

7. A shipping package system as claimed in claim 2 and further comprising at least a first tier and a second tier of first and second pads and vertically-stacked webbing rolls, wherein each of said webbing rolls positioned between first and second pad second passages is generally movable along said major axis to tangentially contact at least two webbing rolls of said tier.

8. A shipping package system as claimed in claim 1, further comprising at least a first tier and a second tier of first and second pads and webbing rolls, which webbing rolls are arranged in a vertically-stacked alignment; said second tier vertically arranged atop said first tier with said first and second passages of said first and second pads in vertical alignment with said first and second passages of said first tier and secured with said first tier to said platform by said means for securing.

9. A shipping package system as claimed in claim 1, wherein said means for securing are binding straps, said system further comprising an upper frame; one of said first and second pads operable as an upper package surface, said frame overlaying said upper package surface; said bindings extending over said upper frame and said platform to secure said frame, webbing rolls and pads to said platform.

10. A shipping package system as claimed in claim 9, wherein each of said pads has at least two pad corners; and said frame has at least two frame corners which frame corners are angled to approximately conform to the shape of said pad corners.

11. A shipping package system as claimed in claim 1 wherein said first passages are approximately circular and include a passage diameter, said outer diameter of said tubular core being less than said passage diameter, said first passages operable to maintain said webbing rolls approximately stationary.

12. A shipping package system as claimed in claim 11 wherein said plurality of first passages are positioned at a first radius from said center of said first and second pad.

13. A shipping package system as claimed in claim 1, wherein said pads are formed from fiberboard.

14. A shipping package system as claimed in claim 1 wherein each of said pads are formed with a laminate structure, said laminate structure comprising a first fiberboard layer, a second fiberboard layer and a honeycomb fiberboard structure between said first layer and second layer.

15. A shipping package system as claimed in claim 1, wherein said first and second passages in each of said pads are through-passages.

16. A shipping package system as claimed in claim 1, wherein each pad has an upper layer, a lower layer and a centerline divider between said upper and lower layers; said first and second passages are depressions in each said pad at each of said upper and lower layers, which depressions are aligned with a first and second passage, respectively, at the other of said upper and lower layers.

17. A shipping package system as claimed in claim 1, further comprising at least one buffer sheet, said buffer sheet interlaced among said rolls and operable to prevent direct surface-to-surface contact between tangentially contacting webbing rolls.

18. A shipping package system with at least one tier of vertically-stacked webbing rolls, said package system comprising:

a stacking platform;

a plurality of webbing rolls, each webbing roll having a first roll end and a second roll end, which webbing is would on a cylindrical, tubular core, said tubular core having a predetermined outer diameter, a first tube end and a second tube end, said first and second tube ends extending outwardly from each of said webbing roll first and second ends, respectively;

a first pad end and a second pad for said first and second roll ends, respectively, for each said tier, each of said first and second pads having a center, first means for receiving said tube end and maintaining said rolls approximately stationary and second means for receiving said tube ends, said second means for receiving said tube ends radially, outwardly displaced from said center and first means for receiving said tube ends;

means for securing said at least one tier of webbing rolls and pads, with said platform;

each of said first and second pads arranged to provide each of said first and second means for receiving said tube ends of one of said first and second pads in alignment with a mating first and second means for receiving said tube ends in the other of said first and second pads;

a webbing roll tubular core extending between and into each of said aligned pair of first and second means for receiving said tube ends, said webbing rolls radially movable from said center in said second means for receiving said tube ends to tangentially contact at least two of said webbing rolls of said tier;

said means for securing operable to secure said webbing rolls and pads to said platform.

19. A pad for a shipping package system for transport and storage of webbing wound on tubular cores to form webbing rolls with a first end and a second end, said tubular cores having a first core end and a second core end extending from said webbing roll; said pad comprising an upper surface, a lower surface, and a center position on said upper and lower surface, a plurality of first passages positioned about said center position and a plurality of sets of second passages, each of said sets of second passages operable with one of said first passages; each pad having radii extending from said center position; each of said second passages being generally elliptically shaped and having a major axis and at least one minor axis, each of said second passages having its major axis approximately aligned along one of said radii; each of said plurality of first and plurality of second passages operable to receive one of said extending first and second core ends for vertical stacking of said webbing rolls, which second passages allow movement of said tubular core ends in said second passages along said major axis and inhibit webbing roll rotational movement about said center position.

20. A pad for a shipping package system as claimed in claim 19 wherein said pad has an upper layer, a lower layer, and a centerline divider therebetween said first passages and said second passages are depressions in each said upper and lower layers, which depressions are aligned with a first and second depression at the other of said upper and lower layers.

21. A pad for a shipping package system as claimed in claim 19 wherein said first and second passages are through passages in said pads.

* * * * *